US011779796B2

(12) United States Patent
Larson et al.

(10) Patent No.: US 11,779,796 B2
(45) Date of Patent: Oct. 10, 2023

(54) PORTABLE EXERCISE DEVICE

(71) Applicant: 2-B-Fit LLC, Highlands Ranch, CO (US)

(72) Inventors: Alan Gene Larson, Highlands Ranch, CO (US); Michael Walker Larson, Highlands Ranch, CO (US); Trent Evan Garner, Highlands Ranch, CO (US)

(73) Assignee: 2-B-Fit LLC, Highlands Ranch, CO (US)

( * ) Notice: Subject to any disclaimer, the term of this patent is extended or adjusted under 35 U.S.C. 154(b) by 146 days.

(21) Appl. No.: 17/245,966

(22) Filed: Apr. 30, 2021

(65) Prior Publication Data

US 2021/0339077 A1 Nov. 4, 2021

Related U.S. Application Data

(60) Provisional application No. 63/019,269, filed on May 2, 2020.

(51) Int. Cl.
*A63B 21/00* (2006.01)

(52) U.S. Cl.
CPC ..... *A63B 21/4001* (2015.10); *A63B 21/153* (2013.01); *A63B 21/4007* (2015.10); *A63B 21/4009* (2015.10); *A63B 2225/09* (2013.01)

(58) Field of Classification Search
CPC ..... A63B 21/4001; A63B 21/153; A63B 21/4007; A63B 21/4009; A63B 2225/09; A63B 21/015; A63B 21/4043; A63B 23/1209; A63B 23/03541
See application file for complete search history.

(56) References Cited

U.S. PATENT DOCUMENTS 3,162,442 A * 12/1964 Karlik ..... A63B 21/4005 24/129 R
3,477,410 A * 11/1969 Lettieri ..... A01K 27/004 119/794
4,944,511 A * 7/1990 Francis ..... A63B 21/153 482/123
4,961,573 A * 10/1990 Wehrell ..... A63B 21/4007 482/124
5,234,395 A * 8/1993 Miller ..... A63B 21/018 482/114
5,328,432 A * 7/1994 Gvoich ..... A63B 21/00069 482/114
5,358,461 A * 10/1994 Bailey, Jr. ..... A63B 21/153 290/1 R
5,618,249 A * 4/1997 Marshall ..... A63B 21/4001 482/92
5,733,231 A * 3/1998 Corn ..... A63B 21/153 482/127
5,792,034 A * 8/1998 Kozlovsky ..... A63B 21/4025 482/124
5,795,274 A * 8/1998 Kasbohm ..... A63B 21/00069 482/126

(Continued)

*Primary Examiner* — Andrew S Lo
*Assistant Examiner* — Andrew M Kobylarz
(74) *Attorney, Agent, or Firm* — Armstrong Teasdale LLP

(57) ABSTRACT

The present disclosure describes a portable exercise device that may be arranged in a number of different orientations and positions on the body of an individual. The portable exercise device includes a resistance assembly that enables a resistance of the portable exercise device to be adjusted.

17 Claims, 7 Drawing Sheets

(56) References Cited

U.S. PATENT DOCUMENTS 6,099,447 A * 8/2000 Ramsaroop ..... A63B 21/153 482/127
6,120,422 A * 9/2000 Kiemer ..... A63B 21/4035 482/114
6,280,365 B1 * 8/2001 Weber ..... A63B 21/4001 482/124
6,688,260 B2 * 2/2004 Morrison ..... A01K 27/004 119/796
6,845,736 B1 * 1/2005 Anderson ..... A01K 27/004 119/796
7,087,001 B1 * 8/2006 Ihli ..... A63B 21/015 D30/153
7,289,259 B2 * 10/2007 Chui ..... G09G 3/3466 359/223.1
7,402,147 B1 * 7/2008 Allen ..... A61F 5/373 602/5
7,563,212 B2 * 7/2009 Smith ..... A63B 21/4025 482/124
9,320,936 B1 * 4/2016 Rea ..... A63B 23/1209
9,362,803 B2 * 6/2016 Panousis ..... H02J 7/34
10,207,140 B2 * 2/2019 Carriere, Jr. ..... A63B 23/1209
10,576,325 B2 * 3/2020 Tedesco ..... A63B 21/153
10,888,728 B2 * 1/2021 Carriere ..... A63B 21/4005
2003/0054924 A1 * 3/2003 Amore ..... A63B 21/4025 482/92
2004/0053755 A1 * 3/2004 Wilkinson ..... A63B 23/03541 482/126
2011/0111890 A1 * 5/2011 Webb ..... A63B 21/4025 482/124
2011/0183819 A1 * 7/2011 Pharoe ..... A63B 21/4025 482/105
2013/0324366 A1 * 12/2013 Pride ..... A63B 21/153 482/1
2016/0206912 A1 * 7/2016 Carriere, Jr. ..... A63B 21/0428
2017/0100626 A1 * 4/2017 Ko ..... A63B 21/153
2019/0022452 A1 * 1/2019 Tedesco ..... A41D 1/04
2019/0175975 A1 * 6/2019 Carriere ..... A63B 21/4043
2020/0155891 A1 * 5/2020 Tedesco ..... A63B 21/055

* cited by examiner

PORTABLE EXERCISE DEVICE

CROSS-REFERENCE TO RELATED APPLICATION

The present application claims priority to U.S. Provisional Application No. 63/019,269, filed on May 2, 2020, and titled "Portable Exercise Device", the entire disclosure of which is hereby incorporated by reference in its entirety.

BACKGROUND

More and more individuals are exercising to maintain their health. However, between travel, work, school and other activities, it may be difficult for an individual to find time to exercise. Additionally, workout equipment may be expensive and an individual may need to buy various different exercise devices to exercise different parts of her body.

SUMMARY

The present application describes an exercise device that may be portable and/or be worn by an individual. In an example, the exercise device may be worn by the individual in a number of different configurations and/or orientations. Additionally, at least a portion of the exercise device may be moveable and/or rotatable such that the individual has a number of different options regarding the types of exercises being performed. The exercise device may be used by the individual to increase the individual's muscle tone and total body fitness.

In some examples, the portable exercise device may be worn on or around the front or back of the waist. In other examples, the portable exercise device may be worn on or around the individual's waist, chest, side and/or back. In yet another example, one component or portion of the portable exercise device may be removably coupled to another component or portion of the portable exercise device. In each of these arrangements, the portable exercise device provides resistance training to the individual's arms, legs, shoulders, feet, stomach, and back.

Accordingly, the present application describes a portable exercise device that includes a securement mechanism and a rail extending at least partially along a length of the securement mechanism. In an example, the rail defines a plurality of indentations. A housing is coupled to the rail and is releasably positionable at each of the plurality of indentations. The housing is also rotatable about an axis such that a handle extending from an opening defined by the housing is positionable at a plurality of continuous positions about the axis. A resistance assembly is at least partially enclosed by the housing and a cord is coupled to the handle. The cord extends from the resistance assembly and is adapted to wind onto the resistance assembly and unwind from the resistance assembly in response to movement by an individual.

The present application also describes a wearable exercise device that includes a securement mechanism and a rail coupled to the securement mechanism. The rail defines a plurality of indentations. A housing is slidably coupled to the rail and is positionable at each of the plurality of indentations. In an example, the housing is continuously rotatable about an axis. The wearable exercise device also includes a resistance assembly at least partially enclosed by the housing. The wearable exercise device also includes a tension mechanism that increases or decreases a tension of the resistance assembly.

Also described is a wearable exercise device that includes a securement mechanism and a rail coupled to the securement mechanism. A housing is slidably coupled to the rail and is positionable at a plurality of locations along the rail. A resistance assembly is at least partially enclosed by the housing. The wearable exercise device also includes a tension mechanism that increases or decreases a tension of the resistance assembly.

BRIEF DESCRIPTION OF THE DRAWINGS

Non-limiting and non-exhaustive examples are described with reference to the following Figures.

DETAILED DESCRIPTION

Figure 1A:
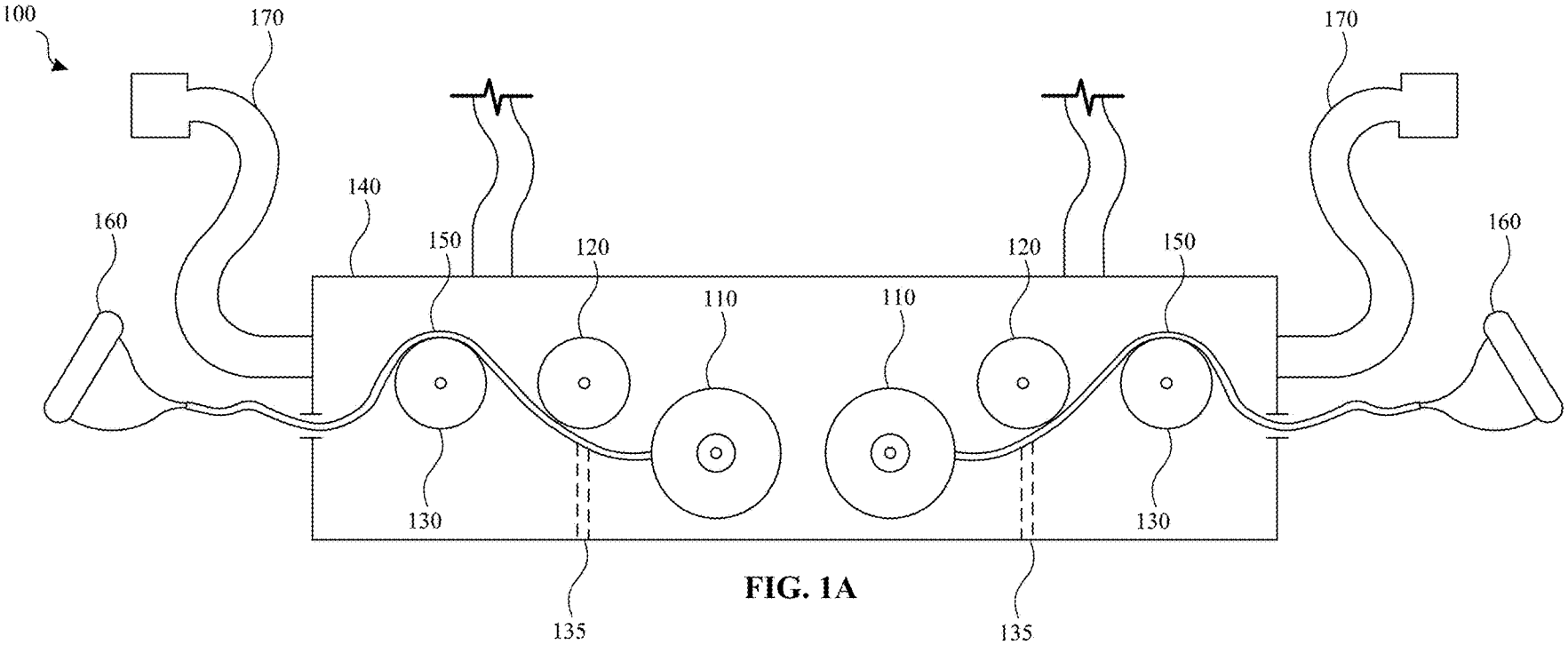
FIG. 1A illustrates a portable exercise device according to an example.

In the following detailed description, references are made to the accompanying drawings that form a part hereof, and in which are shown by way of illustrations specific embodiments or examples. These aspects may be combined, other aspects may be utilized, and structural changes may be made without departing from the present disclosure. Examples may be practiced as methods, systems or devices. Accordingly, examples may take the form of a hardware implementation, an entirely software implementation, or an implementation combining software and hardware aspects. The following detailed description is therefore not to be taken in a limiting sense, and the scope of the present disclosure is defined by the appended claims and their equivalents.

The present application describes a portable/wearable exercise device. The portable exercise device of the present application is configured such that an individual may wear the portable exercise device on different parts of her body and in different orientations. For example, the individual may wear the portable exercise device on her waist. In another example, the individual may wear the portable exercise device on or near her chest. In yet another example, the individual may wear the portable exercise device as a bandolier. Although specific examples are given, the portable exercise device of the present application may be configured to be worn on many different parts of a body of an individual based on the desires of the individual. Additionally, each orientation or position of portable exercise device may enable the individual to perform a number of different exercises.

The portable exercise device may also be "reversable." For example, the portable exercise device may be worn on a back side of the individual or a front side of the individual. As such, the portable exercise device may enable the individual to exercise various parts of her body—all with a single device. For example, and depending on how the individual arranges the portable exercise device, the individual may connect the cords to her arms or legs and perform a number of different exercises and select a number of different resistance levels.

The portable exercise device includes a securement mechanism such as a belt, a strap, a harness or other such mechanism that enables the portable exercise device to be removably secured on a portion of a body (e.g., a waist) of the individual. The wearable exercise device also includes an attachment mechanism that enables a housing and tension assembly to be coupled to the securement mechanism. In an example, the housing and the tension assembly may be moveable along and/or removably coupled to the securement mechanism. For example, the securement mechanism may include an attachment mechanism (e.g., a rail, one or more protrusions) that enables the housing and the tension assembly to be coupled thereto. The housing assembly may be movable around its axis so as to enable a handle extending from the housing to be manipulated in a number of different angles and/or directions.

These and other examples will be shown in more detail with respect to FIG. 1A-FIG. 4B.

FIG. 1A illustrates a portable exercise device 100 according to an example. The portable exercise device 100 may include a number of different resistance mechanisms. For example, the portable exercise device 100 may include a first resistance mechanism 110, a second resistance mechanism 120 and a third resistance mechanism 130. Although three different resistance mechanisms are shown, the portable exercise device 100 may include any number of different resistance mechanisms. In some examples, the individual may add resistance mechanisms to or remove resistance mechanisms from the portable exercise device 100.

As shown in FIG. 1A, the portable exercise device includes a set of first resistance mechanisms 110, a set of second resistance mechanisms 120, and a set of third resistance mechanisms 130. The resistance mechanisms (and other components of the portable exercise device) may be used for different sides of the body of the individual. For example, a first set of resistance mechanisms, a handle 160, a cord 150, etc., may be used for the left side of individual's body (e.g., left arm, left leg, etc.) and a second set of resistance mechanisms, handle 160, cord 150, etc. may be used for the right side of the individual's body (e.g., right arm, right leg, etc.).

In some examples, the first resistance mechanism 110 may be a retractable spring reel, a spring-loaded pulley or other such mechanical mechanism/device that enables a cord 150 to be wound and unwound therefrom in response to movement of an individual. For example, as the individual extends her right arm and/or left arm, a corresponding first resistance mechanism 110 moves about an axis or otherwise rotates in a particular direction to unwind the cord 150 from the first resistance mechanism 110 thereby extending the length of the cord 150. As the individual retracts her right arm and/or left arm, the corresponding first resistance mechanism 110 moves about an axis or otherwise rotates in an opposite direction to wind the cord 150 onto or within the first resistance mechanism 150 thereby shortening the overall length of the cord 150.

Figure 1B:
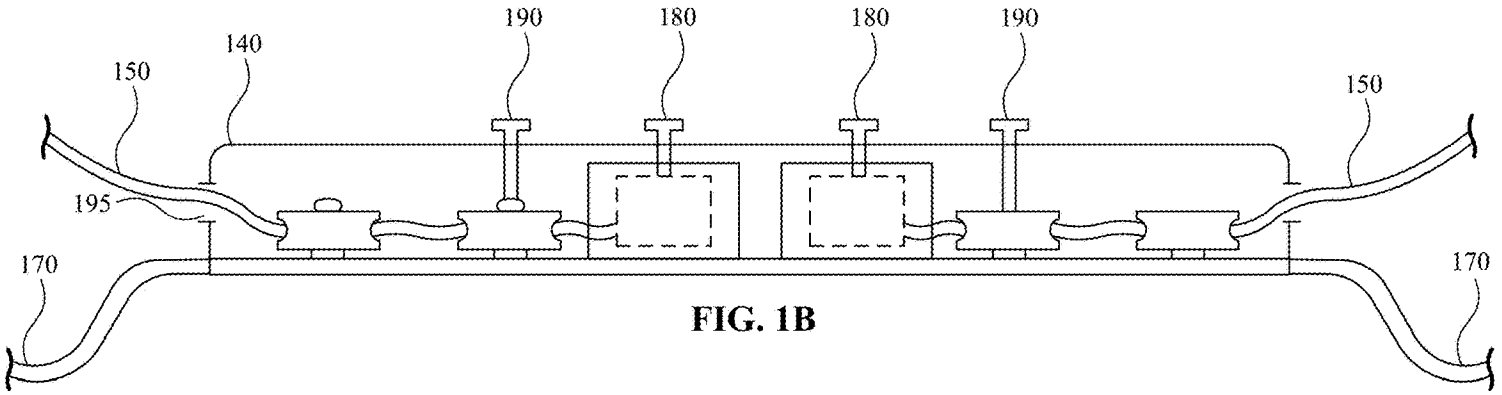
FIG. 1B illustrates a top view of the portable exercise device of FIG. 1A according to an example.

Referring to FIG. 1B, the first resistance mechanism 110 may include or otherwise be associated with a tension mechanism 180. The tension mechanism 180 may be a mechanical device, such as a dial or other such mechanical device or actuation mechanism. When actuated, the tension mechanism 180 increases or decreases tension associated with or otherwise provided by the first resistance mechanism 110. For example, as the tension mechanism 180 is actuated, a spring tension of a spring associated with or otherwise integrated with the first resistance mechanism 110 may increase or decrease. As such, rotational movement of the first resistance mechanism 110 may be impeded/restricted to increase resistance or may be facilitated/permitted to decrease resistance.

Referring back to FIG. 1A, the portable exercise device 100 may also include one or more additional resistance mechanisms. For example and as shown in FIG. 1A, the portable exercise device 100 includes a second resistance mechanism 120 and a third resistance mechanism 130. Each of the second resistance mechanism 120 and the third resistance mechanism 130 may be pulley type mechanisms. As such, the second resistance mechanism 120 and/or the third resistance mechanism 130 may include a rim or edge that guides the cord 150 as the cord 150 unwinds from or winds onto/within the first resistance mechanism 110. Although not shown in FIG. 1A, the cord 150 may be wrapped substantially around or entirely around the second resistance mechanism 120 and/or the third resistance mechanism 130 to increase the resistance for the individual. In another example, the cord 150 may be removed from the second resistance mechanism 120 and/or the third resistance mechanism 130 to decrease the resistance.

In some examples, the second resistance mechanism 120 and/or the third resistance mechanism 130 may be associated with or otherwise moveably coupled to a track 135. The track 135 enables a position of the second resistance mechanism 120 and/or the third resistance mechanism 130 to be adjusted by the individual. The position of the resistance mechanisms may be adjusted in any direction (e.g., up, down, left, right, diagonally, etc.) so long as the track 135 extends in the desired direction. In some example, the position and/or orientation of the track 135 may be adjusted. In another example, the portable exercise device may have multiple tracks 135 and each track 135 may be positioned in a different orientation. As the individual adjusts the position of the second resistance mechanism 120 and/or the third resistance mechanism 130, the resistance for the individual may increase or decrease accordingly.

As shown in FIG. 1B, the second resistance mechanism 120 (and/or the third resistance mechanism 130) may be associated with an adjustment mechanism 190. The adjustment mechanism 190 may be a mechanical device such as a dial or other such device that, when actuated, causes the resistance mechanisms (e.g., the second resistance mechanism 120) to move along the track 135. In some examples, actuation of the adjustment mechanism 190 may also impede/restrict or facilitate/permit rotational movement of the second resistance mechanism 120. For example, actuation of the adjustment mechanism 190 in one direction may cause an increase in the tension on the second resistance mechanism 120. As such, resistance felt by the individual may increase. Likewise, actuation of the adjustment mechanism 190 in a different direction may decrease tension on the second resistance mechanism 120. As such, resistance felt by the individual may decrease.

In some examples, the first resistance mechanism 110, the second resistance mechanism 120 and the third resistance mechanism 130 (and tension mechanism 180 and the adjustment mechanism 190) may be enclosed within or otherwise contained in a pouch 140 or other such housing. The pouch 140 may define an opening 195 (FIG. 1B) that enables the cord 150 to pass therethrough. The opening 195 may be sized to enable the cord 150 to pass through but may be configured to prevent an accessory 160, such as a handle, from entering the pouch 140. In some examples, the opening 195 may include a grommet or other such mechanism that facilitates movement of the cord 150 through the opening 195 thereby reducing wear and tear of the pouch 140 and/or the cord 150.

The pouch 140 may be made of any suitable material (e.g., nylon, canvas etc.). The pouch 140 may be flexible which allows the pouch 140 to be placed on many different positions/locations on the individual. The pouch 140 and/or the portable exercise device 100 may include padding to provide additional comfort to the individual. The pouch 140 may also include one or more structured support mechanisms that provide support for the various resistance mechanisms.

The pouch 140 may also include a zipper or other device that enables the pouch 140 to be opened and closed. As such, the individual may access the various resistance mechanisms within the pouch 140. In some examples, resistance mechanisms may be added to or removed from the portable exercise device 100. In other examples, the individual may manually (or mechanically) adjust a travel path of the cord 150 to adjust the resistance provided by the portable exercise device 100.

For example, the individual may remove the cord 150 from traveling around the third resistance mechanism 150 in order to decrease resistance. In another example, the individual may add an additional resistance mechanism to the portable exercise device 100 and arrange the cord 150 such that the cord 150 is threaded through or otherwise actuates each of the resistance mechanisms which may subsequently increase resistance. As such, the individual may need access to the inside of the pouch 140.

As briefly discussed above, the portable exercise device 100 may also include an accessory 160. In the example shown, the accessory 160 is a handle. The accessory 160 may be removably coupled to the cord 150 such that an individual may be able to switch accessories depending on the desired type of exercises. For example, if the individual wants to exercise her arms, handles may be removably coupled to the cord 150. If the individual wants to exercise her legs, one or more straps may be removably coupled to the cord 150 and subsequently secured to the individual's feet or ankles. Although specific examples are given, other accessories 160 may be removably coupled to the cord 150 such as, for example, weights, walking/hiking poles, and so on.

In some examples, the accessory 160 may include a dial or other actuation mechanism (similar to tension mechanism 180 and adjustment mechanism 190) that enables the individual to adjust the resistance/tension of the portable exercise device 100. In examples in which the tension mechanism 180 and/or the adjustment mechanism 190 are included with an accessory 160, the tension mechanism 180 and the adjustment mechanism 190 may be removed from the first resistance mechanism 110 and/or the second resistance mechanism 120.

The portable exercise device 100 may also include one or more straps 170. The straps 170 may be adjustable and may be used to secure the portable exercise device 100 to the individual. For example, the portable exercise device 100 may include straps 170 that fit around a waist of the individual. In another example, shoulder straps may be used to secure the portable exercise device 100 around the chest and/or shoulders of the individual. In some examples, the straps 170 may be removably coupled to the pouch 140.

Figure 2A:
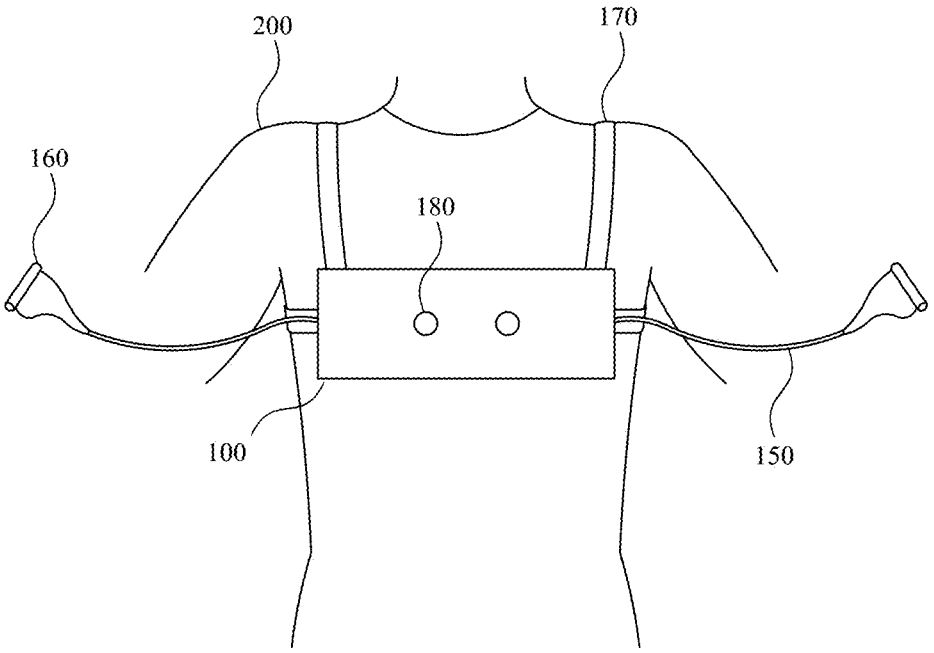
FIG. 2A-FIG. 2B illustrate the portable exercise device of FIG. 1A being worn by an individual in a first configuration according to an example.
Figure 2B:
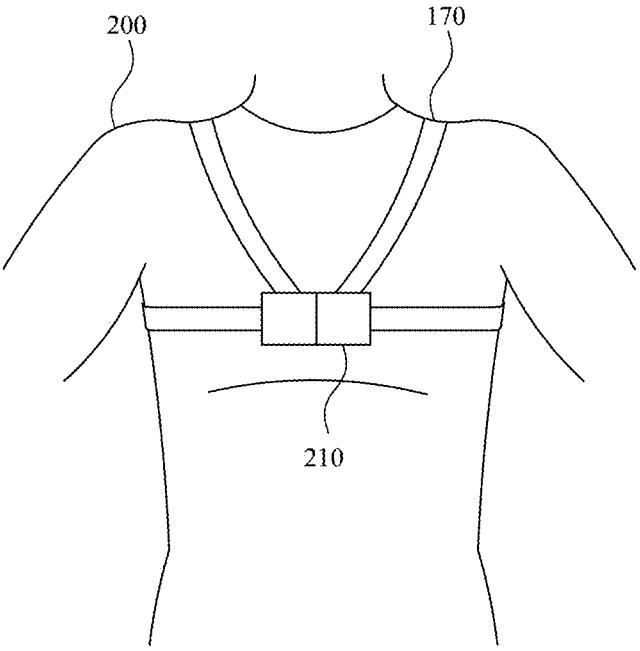

FIG. 2A-FIG. 2B illustrate the portable exercise device 100 of FIG. 1A being worn by an individual 200 in a first configuration according to an example. As shown in FIG. 2A-FIG. 2B, the portable exercise device 100 may be positioned on or near the chest of the individual 200. In some examples, the straps 170 of the portable exercise device may include a clip 210 or other such fastener that secures the portable exercise device 100 to the individual. As also discussed above, the portable exercise device 100 may be reversable such that the portable exercise device 100 may be positioned on a side of the individual 200, a front side of the individual 200 or a back side of the individual 200. Each of the different locations may enable the individual 200 to perform a number of different exercises.

Figure 3A:
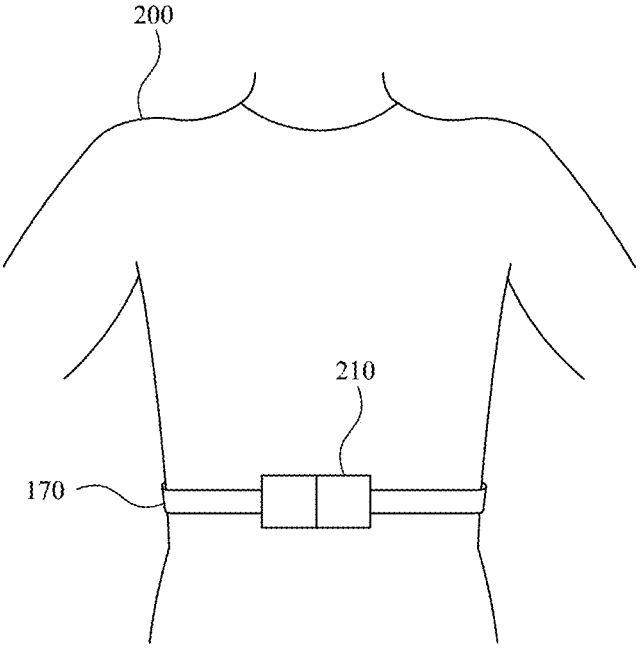
FIGS. 3A-FIG. 3B illustrate the portable exercise device of FIG. 1A being worn by an individual in a second configuration according to an example.
Figure 3B:
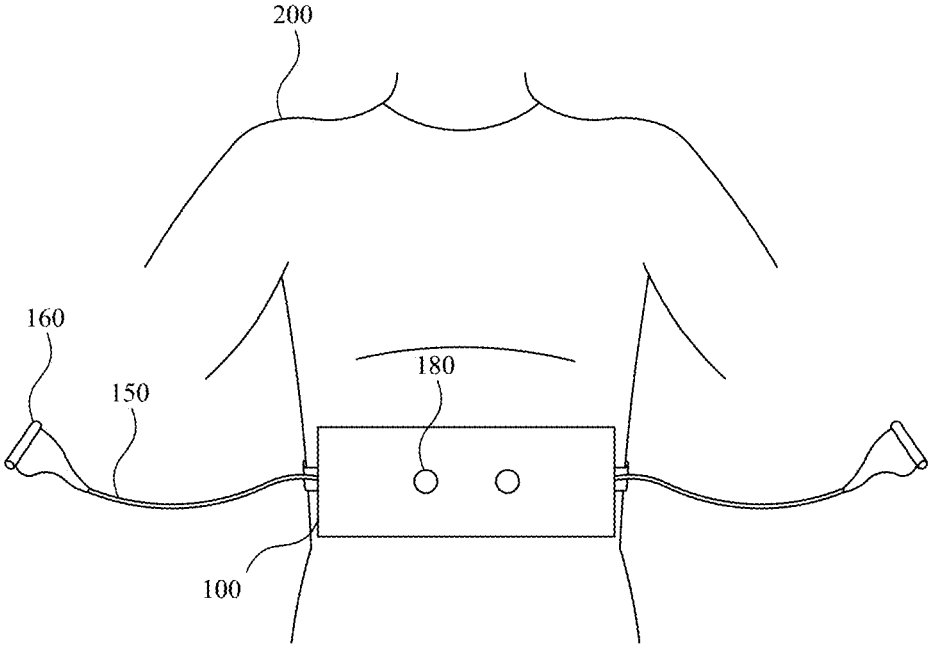

FIG. 3A-FIG. 3B illustrate the portable exercise device 100 of FIG. 1A being worn by the individual 200 in a second configuration according to an example. In this example, the individual 200 is wearing the portable exercise device 100 around his waist. Like the example shown in FIG. 2A-FIG. 2B, the portable exercise device 100 has been secured to the waist of the individual 200 using the straps 170 and clip 210.

Figure 4A:
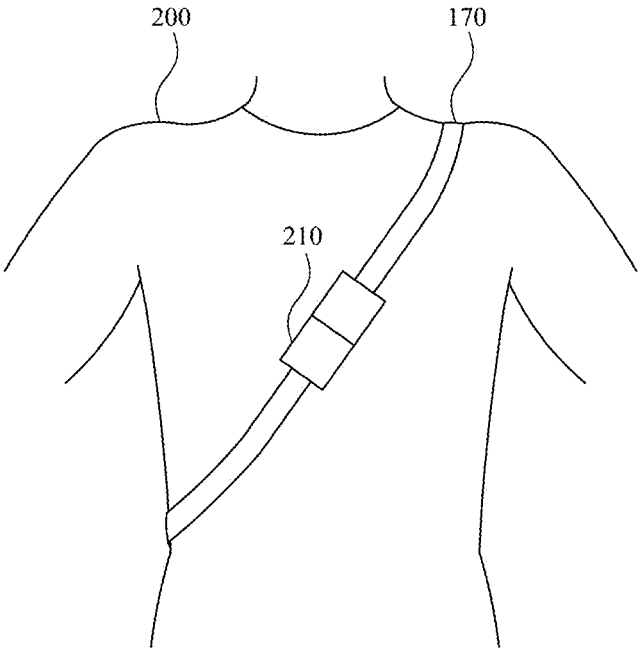
FIG. 4A-FIG. 4B illustrate the portable exercise device of FIG. 1A being worn by an individual in a third configuration according to an example.
Figure 4B:
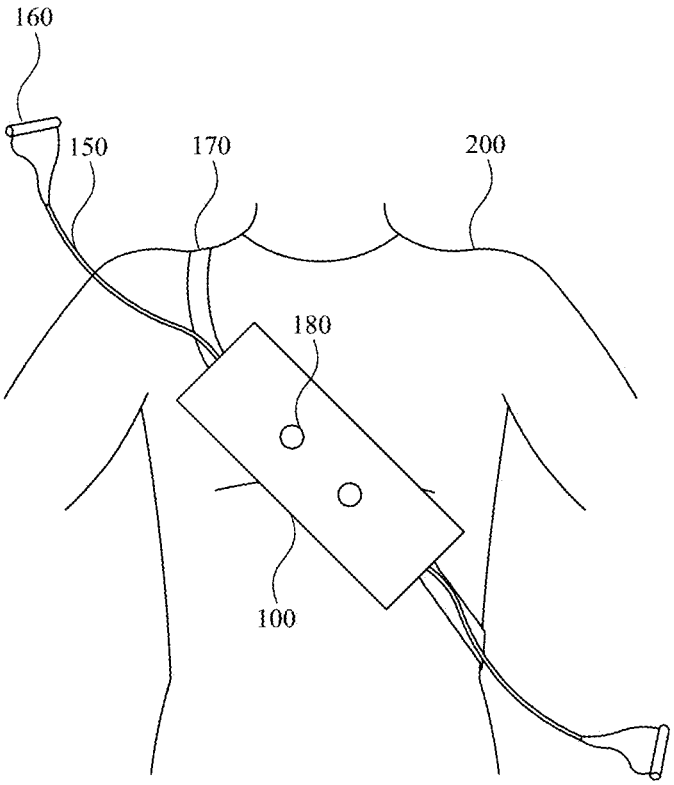

FIG. 4A-FIG. 4B illustrate the portable exercise device 100 of FIG. 1A being worn by the individual 200 in a third configuration according to an example. In this configuration, the portable exercise device 100 is secured to the individual 200 as a bandolier. Like the other examples previously described and shown, the arrangement/position of the portable exercise device 100 in this configuration may enable the individual 200 to perform a number of different exercises.

Although FIG. 2A-FIG. 4B show the portable exercise device 100 in specific orientations and positions, the portable exercise device 100 may be positioned or arranged in a number of different orientations and positions on the body of the individual 200. Each position/orientation may enable the individual to perform exercises on her arms, legs, abs, shoulders, etc. at varying resistance levels.

Figure 5A:
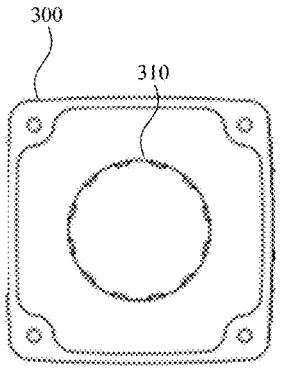
FIG. 5A illustrates an example resistance assembly that may be used to provide resistance for a portable exercise device according to an example.
Figure 5C:
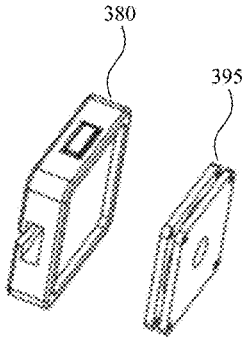
FIG. 5C illustrates additional components of the resistance assembly of FIG. 5A according to an example.
Figure 5B:
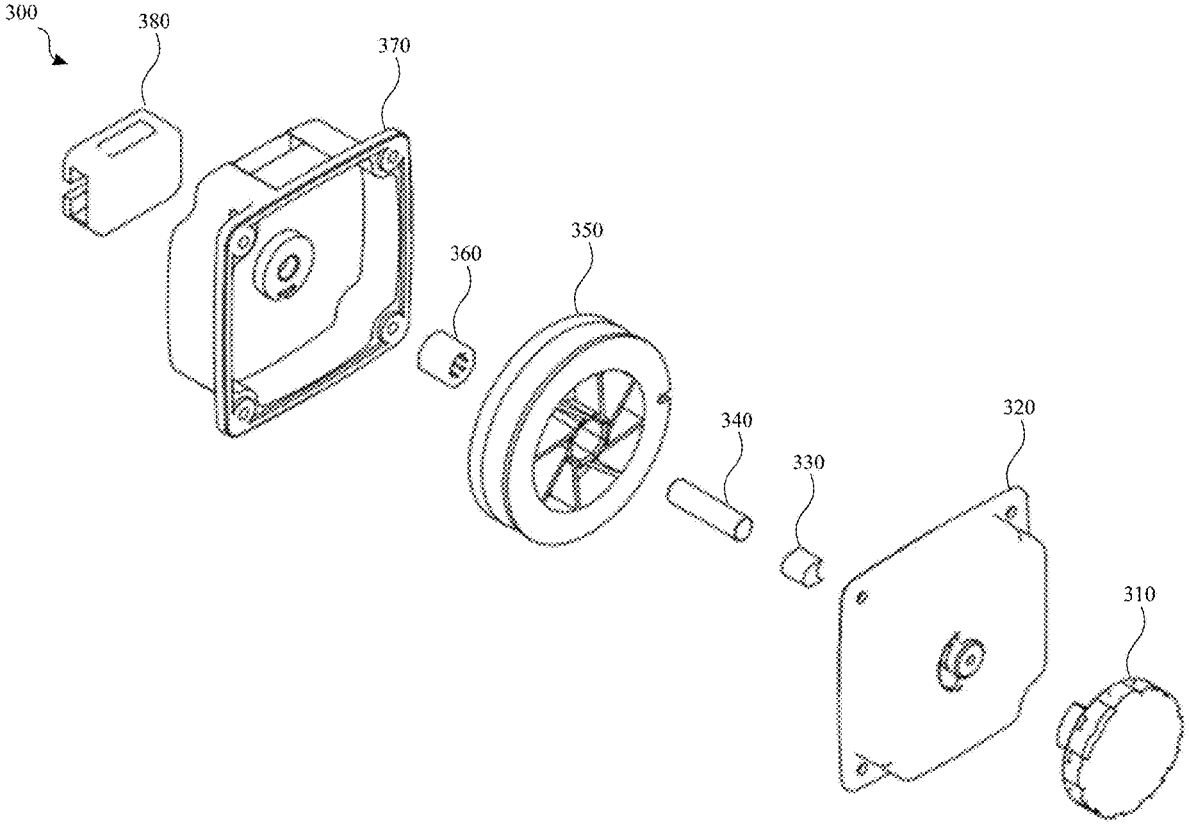
FIG. 5B illustrates an exploded view of the resistance assembly of FIG. 5A according to an example.

FIG. 5A and FIG. 5B illustrate an example resistance assembly 300 that may be used to provide resistance for a portable exercise device according to an example. The resistance assembly 300 may be used with the portable exercise device 100 shown and described with respect to FIG. 1A-FIG. 4B. Additionally, the resistance assembly 300 may be used as part of, or in lieu of, the first resistance mechanism 110, the second resistance mechanism 120 and/or the third resistance mechanism 130. For example, the portable exercise device 100 may use a single resistance assembly 300. In another example, multiple resistance assemblies 300 (or portions of the resistance assembly 300) may be used as the various resistance mechanisms shown and described herein.

As shown in FIG. 5A, the resistance assembly 300 may include a tension mechanism 310. The tension mechanism 310 may be similar to the tension mechanism 180 shown and described with respect to FIG. 1B. The tension mechanism 310 may be a dial, a knob, a key, or other device that enables an individual to increase or decrease a tension associated with or otherwise provided by the resistance assembly 300.

For example, if the tension mechanism 310 is rotated in a clockwise direction, a tension provided by the resistance mechanism 300 may increase. Likewise, if the tension mechanism 310 is rotated in a counter-clockwise direction, the tension provided by the resistance assembly 300 may decrease.

Although a rotation of the tension mechanism 310 is specifically mentioned, other processes of increasing and/or decreasing tension provided by the resistance assembly 300 may be used. For example, moving the tension mechanism 310 in an inward direction (e.g., in response to an individual pushing or pressing the tension mechanism 310) may cause the tension to increase and/or decrease. As will be explained in greater detail below with respect to FIG. 6A-6C, the resistance assembly 300 may be slidably or otherwise moveably coupled to belt, strap or other securement mechanism.

FIG. 5B illustrates an exploded view of the resistance assembly 300 of FIG. 5A according to an example. As described above, the resistance assembly 300 includes a tension mechanism 310 or other such adjustment knob. The resistance assembly 300 may also include an outer housing 320 and an inner housing 370. The outer housing 320 and the inner housing 370 may form an enclosure into which various components of the resistance assembly 300 may be assembled or otherwise contained.

The resistance assembly 300 may also include a drive sheave 350. The drive sheave 350 may be configured to have a cord (e.g., cord 150 (FIG. 1)), cable, rope etc., wind and unwind therefrom in response to movement by the individual. In an example, the drive sheave 350 is rotatably coupled to a resistance shaft 340. For example, the drive sheave 350 and shaft may rotate about an axis as the cord is wound onto and unwound from the drive sheave 350 in response to movement by the individual.

The resistance assembly 300 may also include a brake pad 330. The brake pad 330 may be used to increase or decrease the tension provided by the resistance assembly 300. For example, as the tension mechanism 310 is rotated in a clockwise direction, the brake pad 330 may move toward and/or contact the resistance shaft 340. As the brake pad 330 moves, it contacts the resistance shaft 340. As such, a rotation of the resistance shaft 340 and the drive sheave 350 may be more restricted thereby increasing the resistance/tension. Likewise, as the tension mechanism 310 is rotated in a counter-clockwise rotation and the brake pad 330 moves away from and/or does not contact the resistance shaft 340, the resistance provided by the resistance assembly 300 decreases.

In another example, the resistance assembly 300 may include a slipper clutch. The slipper clutch may be used as a friction brake that provides resistance to the resistance shaft 340. In an example, the slipper clutch may rub or otherwise contact the resistance shaft 340 and cause energy to dissipate due to friction caused by the contact. In an example, a resistance mechanism (e.g., a nut) can be tightened to provide a constant amount of resistance. The resistance mechanism may be coupled to and/or integrated with the tension mechanism 310 so that the individual can adjust the amount of resistance while exercising.

The resistance assembly 300 may also include a bearing 360. In an example, the bearing 360 is a one-way bearing. As such, the bearing 360 engages drive sheave 350 and the resistance shaft 340 in a single direction. For example, the bearing 360 may engage the drive sheave 350 and the resistance shaft 340 on a resistance stroke (e.g., as the cord unwinds from the drive sheave in response to movement by an individual). However, when the resistance stroke is complete and the cord is to be wound onto the drive sheave 350 again, the bearing 360 enables the drive sheave 350 (but not the resistance shaft 340) to rotate about its axis. In an example, a coil spring or other mechanism may be used to wind the cord back onto the drive sheave 350 once the resistance stroke has been completed.

The resistance assembly 300 may also include a sliding mechanism 380 or other adjustment mechanism coupled to the inner housing 370. The sliding mechanism 380 enables the resistance assembly 300 to be moveably, rotatably and/or releasably coupled to a securement mechanism such as, for example a belt, a strap, a harness and the like.

FIG. 5C illustrates additional components of the resistance assembly 300 of FIG. 5A according to an example. In the example shown in FIG. 5C, the sliding mechanism 380 may define an opening in which a rotation mechanism 395 may be associated or integrated with. The rotation mechanism 395 may enable the resistance assembly to rotate about its axis (e.g., such as shown and described by the directional arrow 450 (FIG. 6B)). As discussed above, the sliding mechanism 380 may enable the resistance assembly 300 to move along a belt, strap, harness, etc.

Figure 6B:
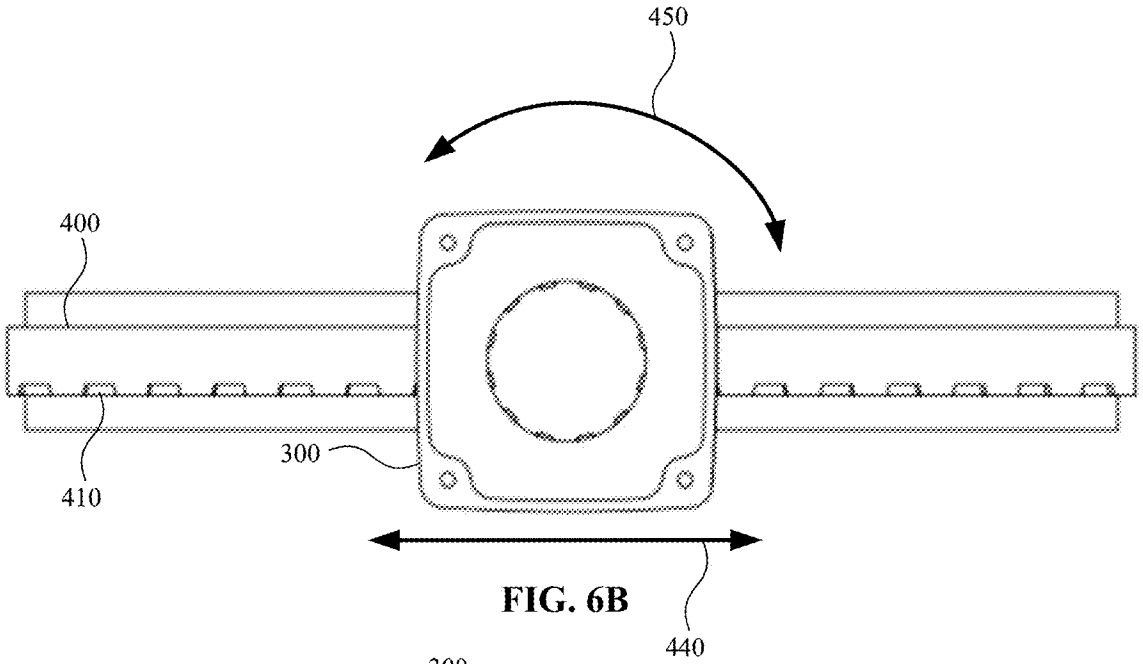
FIG. 6A-FIG. 6C illustrate an example resistance assembly being coupled to a rail according to an example.
Figure 6C:
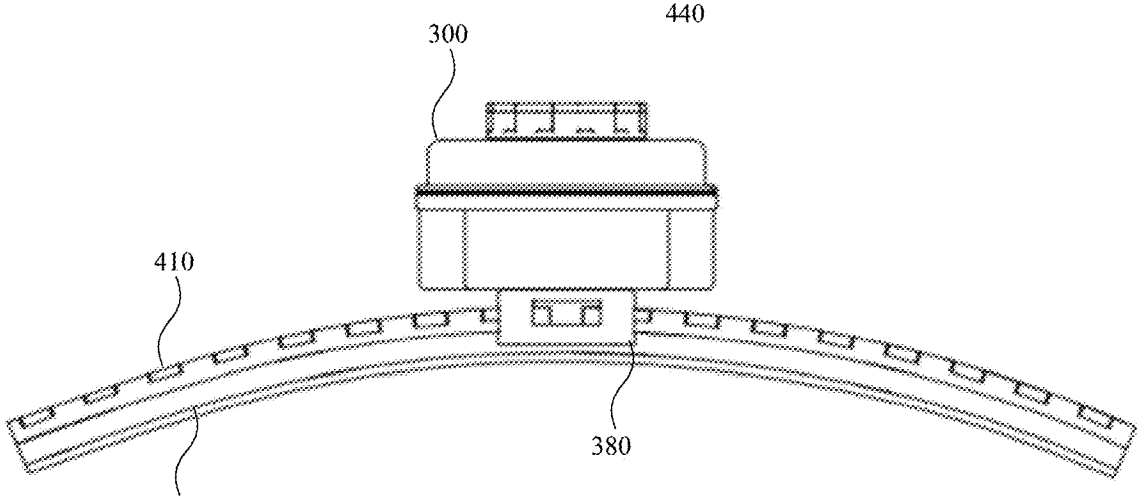
Figure 6A:
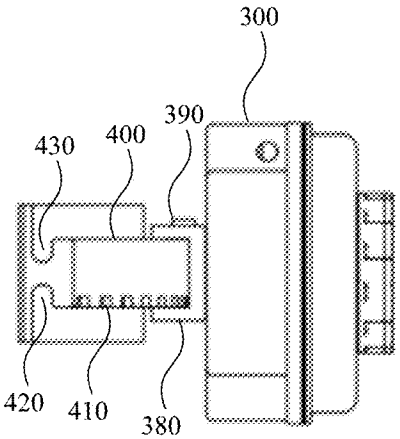

For example and referring to FIG. 6A-FIG. 6C, the resistance assembly 300 may be moveably coupled to a rail 400 via the sliding mechanism 380. In an example, the rail 400 may be coupled to or otherwise integrated with a belt, strap or other securement mechanism. The rail 400 may define opposing channels 420 and 430. The channels 420 and 430 may receive and/or secure at least a portion of the sliding mechanism 380 while enabling the sliding mechanism 380 and the resistance mechanism 300 to move (e.g., laterally) along a length of the rail 400 such as shown by directional arrow 440.

The rail 400 may also define one or more indentations 410 or teeth. In an example, a locking mechanism 390 associated with the sliding mechanism 390 may secure the resistance assembly at a particular location along the rail 400. The locking mechanism 390 may be a spring-loaded locking mechanism that engages with and/or disengages from the indentation 410 in response to actuation by the individual. Although the indentations are shown having a particular shape and location, the indentations 410 may have any shape (e.g., holes, half-circles, triangular) and be located at a number of different locations along the rail 400.

As also shown in FIG. 6B, the resistance mechanism 300 may be rotatable around an axis 450. For example, the resistance mechanism 300 may be rotatably coupled to the sliding mechanism 380. Thus, the resistance mechanism may rotate about its axis as the individual extends, retracts, or otherwise utilizes the resistance assembly 300. As such, the individual is free to use the portable exercise device in any of a number of continuous angles about an axis of the resistance mechanism 300.

The resistance mechanism 300 and/or the sliding mechanism 380 may also include another locking mechanism that locks the rotational angle of the resistance mechanism at particular angles. For example, the locking mechanism may secure the resistance assembly at a ninety-degree angle with respect to the individual to enable the individual to perform particular extension exercises at that given angle.

FIG. 6C illustrates another view of the resistance assembly 300 being moveably coupled to the rail 400. In an example, the rail 400 is flexible which allows the exercise device to be positioned at various locations on a body of the individual. Additionally, the exercise device described herein can be used by individuals with different body types.

Figure 7A:
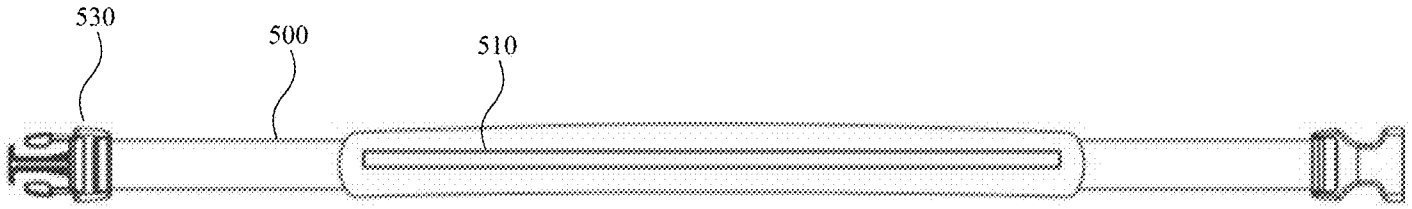
FIG. 7A-FIG. 7B illustrate additional example securement mechanisms that may be used with the resistance assembly described herein
Figure 7B:
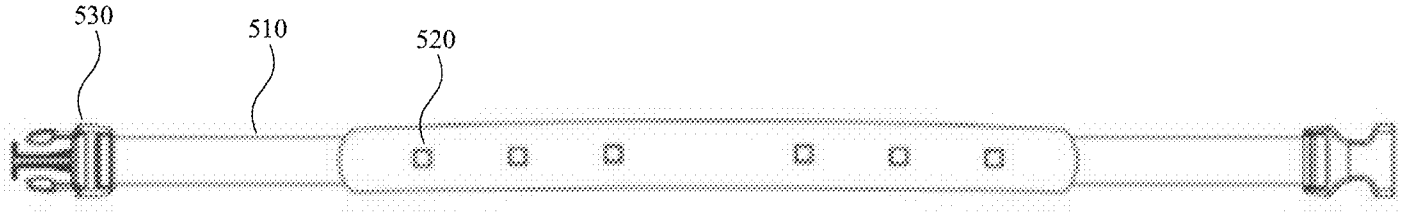

FIG. 7A-FIG. 7B illustrate example securement mechanisms 500 that may be used with the resistance assembly described herein. The securement mechanisms 500 may be a belt, strap, harness or other wearable device that may be used to removably coupled the exercise device described herein to an individual. The securement mechanism 500 may be made from any suitable material such as nylon, leather, and the like. The securement mechanism 500 may include a clip 530.

The securement mechanism 500 shown in FIG. 7A includes a rail 510 that extends at least partially along a length of the securement mechanism 500. The rail 510 enables one or more resistance mechanisms to move along one more continuous or substantially continuous locations along a length of the rail 510. In an example, a sliding mechanism may include a locking mechanism that enables the resistance assembly to be positioned at any continuous or discrete locations along a length of the rail 510.

FIG. 5B shows another example in which the securement mechanism 510 has one or more protrusions 520. Each of the protrusions 520 may be used to receive and secure a resistance assembly thereon. For example, a resistance assembly may be removably and/or rotatably coupled to a particular protrusion 520.

The description and illustration of one or more aspects provided in this application are not intended to limit or restrict the scope of the disclosure as claimed in any way. The aspects, examples, and details provided in this application are considered sufficient to convey possession and enable others to make and use the best mode of claimed disclosure. The claimed disclosure should not be construed as being limited to any aspect, example, or detail provided in this application. Regardless of whether shown and described in combination or separately, the various features (both structural and methodological) are intended to be selectively rearranged, included or omitted to produce an embodiment with a particular set of features. Having been provided with the description and illustration of the present application, one skilled in the art may envision variations, modifications, and alternate aspects falling within the spirit of the broader aspects of the general inventive concept embodied in this application that do not depart from the broader scope of the claimed disclosure.

The invention claimed is:

1. A portable exercise device, comprising:

a securement mechanism for securing the portable exercise device to a body of an individual;

a housing, rotatable about an axis, the housing including a resistance assembly;

an attachment mechanism that couples the housing to the securement mechanism, wherein the resistance assembly comprises:

a tension mechanism coupled to an outer surface of the housing and rotatable about an axis to increase or decrease tension provided by the resistance assembly;

a resistance shaft;

a drive sheave;

a one-way bearing coupled to the drive sheave and the resistance shaft and engaging the drive sheave and the resistance shaft in a first direction and enabling the drive sheave to freely rotate about its axis in a second direction; and a brake pad that restricts rotation of the resistance shaft in response to the tension mechanism being rotated in a first direction; and a cord coupled to a handle, the cord coupled to the drive sheave and extending from the housing and adapted to wind onto the drive sheave and unwind from the drive sheave in response to movement by the individual.

2. The portable exercise device of claim 1, further comprising a locking mechanism that secures the housing at a particular angle of a plurality of continuous angles about the axis.

3. The portable exercise device of claim 1, further comprising a rail extending at least partially along a length of the securement mechanism.

4. The portable exercise device of claim 3, wherein the housing is removably coupled to the rail.

5. The portable exercise device of claim 3, wherein the rail is flexible.

6. The portable exercise device of claim 3, further comprising a sliding mechanism coupled between the rail and the housing.

7. The portable exercise device of claim 6, wherein the sliding mechanism includes a locking mechanism.

8. The portable exercise device of claim 7, wherein the locking mechanism enables the housing to be releasably locked at each of the plurality of indentations.

9. The portable exercise device of claim 3, wherein the rail defines a plurality of indentations.

10. The portable exercise device of claim 9, wherein the housing is coupled to the rail and is releasably positionable at each of the plurality of indentations.

11. A wearable exercise device, comprising:

a belt for securing the wearable exercise device to an individual; and a housing, rotatable about an axis and including a resistance assembly, the resistance assembly comprising:

a dial coupled to an outer surface of the housing and rotatable about an axis to increase or decrease tension provided by the resistance assembly;

a resistance shaft;

a drive sheave;

a one-way bearing coupled to the drive sheave and the resistance shaft and engaging the drive sheave and the resistance shaft in a first direction and enabling the drive sheave to freely rotate about its axis in a second direction; and a brake pad that restricts rotation of the resistance shaft in response to the tension mechanism being rotated in a first direction.

12. The wearable exercise device of claim 11, further comprising a cord coupled to a handle and to the drive sheave.

13. The wearable exercise device of claim 12, wherein the cord extends from the housing and is adapted to wind onto the drive sheave and unwind from the drive sheave in response to movement by the individual.

14. The wearable exercise device of claim 11, further comprising a flexible rail extending at least partially along a length of the belt, the flexible rail defining a plurality of indentations.

15. The wearable exercise device of claim 14, further comprising a sliding mechanism coupled between the flexible rail and the housing.

16. The wearable exercise device of claim 15, wherein the sliding mechanism includes a locking mechanism.

17. The wearable exercise device of claim 16, wherein the locking mechanism enables the housing to be releasably locked at each of the plurality of indentations.

* * * * *